United States Patent [19]

Cazes

[11] 4,364,191

[45] Dec. 21, 1982

[54] PILING RAKE

[76] Inventor: Lyle C. Cazes, 81 Hamm Rd., R. R. 1, Abbotsford, British Columbia, Canada, V2S 1M3

[21] Appl. No.: 199,336

[22] Filed: Oct. 21, 1980

[30] Foreign Application Priority Data

Sep. 29, 1980 [CA] Canada ..... 361482

[51] Int. Cl.[3] ..... A01B 61/04; E02F 3/76

[52] U.S. Cl. ..... 37/2 R; 172/260.5; 172/777; 172/832

[58] Field of Search ..... 172/777, 260.5, 705, 172/832; 37/2 R

[56] References Cited

U.S. PATENT DOCUMENTS

| | | | |
|---|---|---|---|
| 1,898,312 | 2/1933 | Ritchie | 172/832 X |
| 2,770,056 | 11/1956 | Hawkins | 172/705 X |
| 3,042,122 | 7/1962 | Anderson | 172/260.5 |
| 3,349,855 | 10/1967 | Knudson | 172/260.5 |
| 3,480,086 | 11/1969 | Groenke | 172/705 |
| 3,561,541 | 2/1971 | Woelfel | 172/260.5 |

FOREIGN PATENT DOCUMENTS

| | | | |
|---|---|---|---|
| 257544 | 2/1964 | Austria | 172/777 |

*Primary Examiner*—Richard J. Johnson
*Attorney, Agent, or Firm*—Carver & Co.

[57] ABSTRACT

A rake for use with tractors has a blade connectable to a tractor and a plurality of teeth extending from the bottom of the blade. The teeth are pivotally connected to permit movement of the teeth away from objects encountered when the tractor moves. Fluid piston and cylinder combinations interconnect the teeth with the blade so movement of the teeth displaces pressurized fluid within the piston and cylinder combinations. The pressurized fluid reverses the pivotal movement when the teeth clear the objects.

1 Claim, 6 Drawing Figures

FIG 1
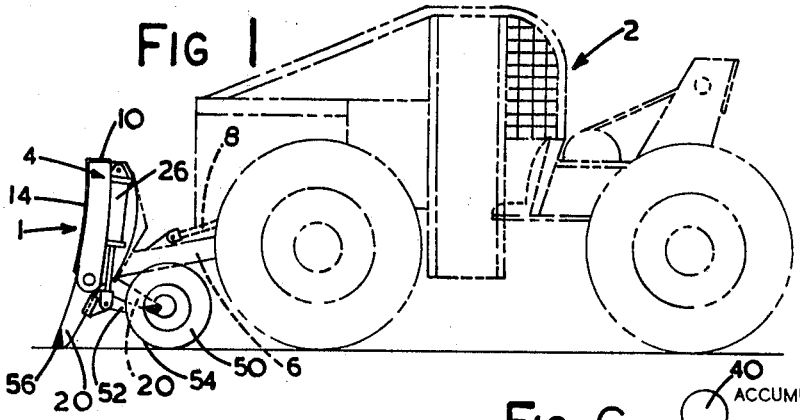
FIG 6
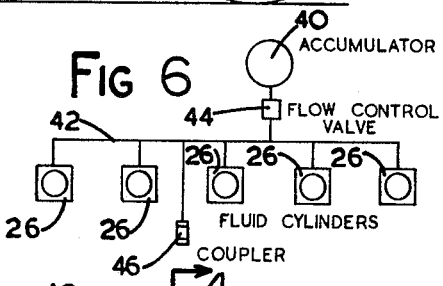
FIG 2
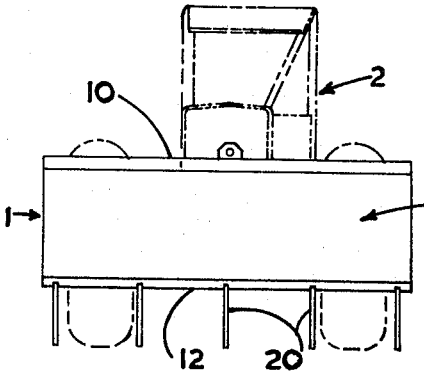
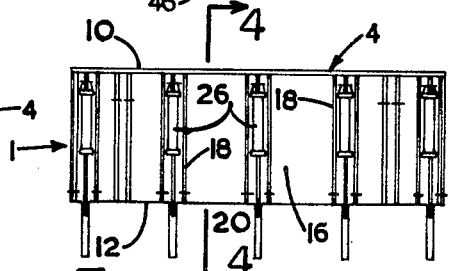
FIG 3
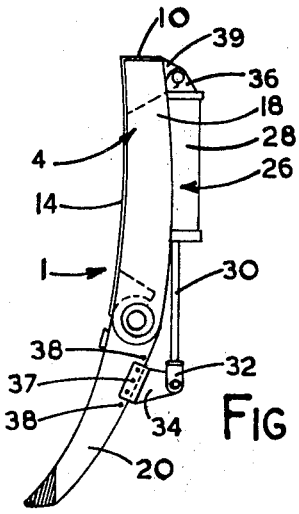
FIG 4
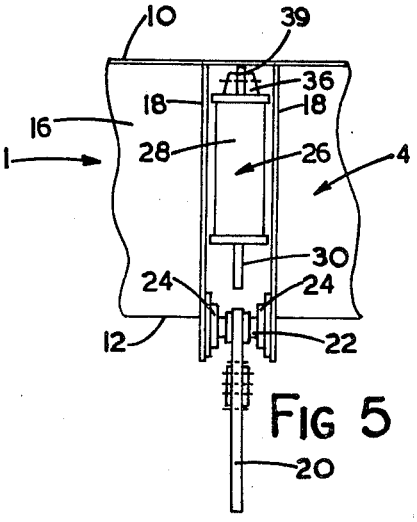
FIG 5

PILING RAKE

BACKGROUND OF THE INVENTION

This invention relates to a piling rake with pivotally mounted teeth which pivot away from objects that provide a certain degree of resistance and which has a hydraulic system for returning the teeth to the original position when each tooth clears the objects.

In logging operations, it is frequently necessary to clear sites of logging slash, brush and other debris prior to reclamation of the land for reforestation purposes. In the past, bulldozers or skidders with conventional blades have been used to push the slash, lower portions of the blades being fitted with fixed rigid teeth spaced between three and four feet apart on the blade. The blade must be raised so the teeth will clear rocks and stumps and the teeth are prone to breaking when they strike such objects.

To try to overcome these problems, attempts have been made to provide spring-loaded teeth which are pivotally mounted so they will gave way when stones, stumps or other such objects are encountered. The hope was that the teeth would deflect when a heavy or stationary object is encountered and then spring back to the normal position after the object is cleared. The general principle is somewhat similar to the ridge leveler blade shown in U.S. Pat. No. 1,744,801 to Rimple which is so constructed that it gives when a rigid obstruction is encountered. Similarly, U.S. Pat. No. 1,511,292 to McLeod discloses a stone rake with yieldable spring biased teeth. U.S. Pat. No. 1,929,799 to Weeks and U.S. Pat. No. 1,876,867 to Dean also disclose scrapers with yieldable blades.

As applied to piling rakes suitable for clearing land in timber operations, it has been found that spring-biased blades provide distinct disadvantages. Firstly, extremely heavy springs are required to provide the necessary resistance so that the teeth will have the necessary pushing force and will yield only when they encounter large rocks, stumps and similar things. Such heavy springs require strong and heavy mounts, complicating the design, and are prone to breaking. Additionally, an extreme hazard is created when the resiliently biased teeth snap back to their original position after the object is cleared. They are liable to strike some object, such as a small stone, and propel it a considerable distance. The danger to persons working in the area is apparent and means that such a device would likely fail to receive approval from authorities concerned with the safety of workers.

Other prior art include U.S. Pat. No. 2,912,774 to McCrary which discloses retractable ripper teeth for a bulldozer blade, U.S. Pat. No. 2,932,100 to Goethe which shows a conventional brush raking arrangement for tractors and U.S. Pat. No. 2,985,973 to Struemph which discloses a self-cleaning timber rake with a movable cleaning bar.

SUMMARY OF THE INVENTION

According to the invention, a rake for use with tractors comprises mounting means connectable to the tractor, the mounting means having a bottom, and a plurality of teeth extending from the bottom of the mounting means. There is pivotal means for pivotally connecting each of the teeth to the mounting means and permitting independent pivotal movement of said each tooth away from objects encountered by said each tooth when the tractor moves. Each of a plurality of fluid piston and cylinder combinations interconnect one of the teeth with the mounting means so the pivotal movement of the teeth displaces pressurized fluid within the piston and cylinder combinations. The pressurized fluid reverses the pivotal movement when the teeth clear said objects.

Preferrably, the rake further comprises means for controlling the rate of the reverse pivotal movement.

The rake may further comprise a fluid accummulator and fluid conduits connecting the accummulator to each of the piston and cylinder combinations, the accummulator receiving pressurized fluid displaced from the piston and cylinder combinations when the teeth are pivotally moved by the objects. In this case, for example, the means for controlling may comprise a flow control valve along the fluid conduits between the accummulator and the piston and cylinder combinations to restrict a return flow of fluid from the accummulator to the piston and cylinder combinations when the teeth clear the objects.

There may be adjustable means connecting the piston and cylinder combinations to the teeth. Each of the adjustable means is connectable to one of the teeth in a plurality of positions along the one tooth to vary the displacement of the piston relative to the cylinder of the piston and cylinder combination connected to the one tooth, thereby varying the pressure of fluid to regulate the force required to cause the pivotal movement of the one tooth.

The invention offers significant advantages when compared to piling rakes having spring-biased pivotal teeth and the prior art devices discussed above. For example, there is no need to provide springs which are subject to breaking, nor the heavy mounting required for such springs. The force required to deflect the teeth is regulated by the fluid pressure and can be adjusted by changing the position where a cylinder is connected to a tooth. The hazard created when spring-loaded teeth snap back into position is completely avoided since it is easy to provide a flow control valve to govern the speed with which the teeth return to their original position after being deflected by an object. It should also be noted that there are no additional controls for the operator of the tractor. The operator is consequently free to concentrate on the task of clearing the land and the teeth are automatically deflected when they encounter objects having a certain resistance and then return to their original position after clearing the objects.

BRIEF DESCRIPTION OF THE DRAWINGS

FIG. 1 is a side elevational view showing a piling rake according to an embodiment of the invention connected to a tractor which is shown in chain lines;

FIG. 2 is a front elevational view of the piling rake and tractor;

FIG. 3 is a rear elevational view of the piling rake;

FIG. 4 is an enlarged sectional view taken along Line 4—4 of FIG. 3; and FIG. 5 is an enlarged fragmentary view of a portion of the back of the piling rake showing one tooth and related cylinder with a portion of the piston rod broken away.

DESCRIPTION OF THE PREFERRED EMBODIMENTS

Referring to FIGS. 1 to 5, a piling rake 1 is shown connected to the front of a tractor 2. The particular kind of tractor illustrated is used in logging operations and is called a skidder. The rake 1 has a mounting means or blade 4 which is connectable to a pair of hinged, spaced-apart arms 6, one of which is shown in FIG. 1, which extend from the front of the tractor. In the common manner, hydraulic cylinders, the piston rod 8 of one of them being visible in FIG. 1, are used to raise or lower the arms 6 and consequently the rake 1.

The blade is constructed of steel plate and is generally conventional, having a top 10, a bottom 12, a front side 14, which is slightly concave from top to bottom, and a back side 16. The front and back sides are substantially vertical when the rake is connected to the tractor as seen in FIG. 1. A plurality of vertical ribs 18 extend vertically along the back side of the blade and are arranged in spaced-apart pairs of ribs as seen best in FIG. 3 and FIG. 5.

A plurality of tines or teeth 20, five teeth in the case of the preferred embodiment, extend from the bottom of the blade. Each of the teeth is pivotally connected to the blade by pivotal means comprising a shaft 22 extending through the top of each tooth and a pair of journals 24 mounted on each pair of ribs 18 and receiving one of the shafts 22. The shafts and journals permit independent pivotal movement of each of the teeth 20 from the normal downwardly extending position, shown in full lines in FIG. 1, to the rearwardly extending position shown in broken lines in FIG. 1. This movement is desirable when a tooth encounters an object, such as a large stone or stump, which would impede the raking operation or possibly break the tooth.

A plurality of fluid piston and cylinder combinations 26, one for each of the teeth 20, interconnect the teeth with the mounting means in a manner so that the pivotal movement of the teeth displaces fluid within the piston and cylinder combinations. The pressure of fluid within the piston and cylinder combinations predetermines the force required to deflect the teeth 20 and the pressurized fluid tends to reverse the pivotal movement when a tooth clears the object which caused the tooth to pivot.

Referring to FIGS. 4 and 5, each of the piston and cylinder combinations is mounted on the back side 16 of the blade between a pair of the ribs 18 together with one of the teeth 20. The combination consists of a fluid cylinder 28 and a piston rod 30 which is connected to an internal piston. A clevis 32 at a first or bottom end of each piston and cylinder combination serves as a first pivotal connection to connect the combination to a lug 34 which is connected to one of the teeth 20. Another clevis 36 at a second or top end of the combination serves as a pivotal connection with the blade 4 near the top thereof. The clevis 36 is on the cylinder 28, while the clevis 32 is on the piston rod 30.

Each of the lugs 34 referred to above has at least one aperture for receiving a nut and bolt combination 37, three apertures and three sets of nuts and bolts being illustrated in FIG. 4. Each of the blades has a plurality of apertures 38 for receiving the bolts, the embodiment shown in FIG. 4 having five such apertures 38. It is therefore clear that this method of connecting the lugs 34 to the teeth 20, including having a greater number of apertures in the teeth than in the lugs, allows the lugs to be connected to the teeth in a plurality of positions along the teeth. This provides adjustable means connecting the piston and cylinder combinations to the teeth. This adjustable connection means that the displacement of the piston in the piston and cylinder combination 26 can be varied relative to the cylinder for each of the teeth 20 in the normal downwardly extending position illustrated in FIG. 4. Changing the displacement of the piston relative to the cylinder accordingly varies the pressure of fluid within the cylinder and sets the amount of force required to cause the tooth to move rearwardly to the position shown in broken lines in FIG. 1. This is desirable because it allows the operator to determine which objects will be pushed by the teeth and which will be left behind. When the rake is used to clear swampy ground, for example, the force required to deflect the teeth 20 would be set relatively low in order to leave stumps behind because stumps are easily pulled out of swampy ground as opposed to harder soil. In swampy ground, therefore, each of the lugs 34 would be moved downwardly from the normal position shown in FIG. 4 and this would increase the displacement within the cylinders 28 and decrease the fluid pressure. The force would obviously be increased by moving the lugs upwards and increasing the fluid pressure.

The fluid piston and cylinder combinations 26 illustrated in FIGS. 1 and 3 to 5 are connected to a hydraulic system illustrated in FIG. 6. The piston and cylinder combinations are connected to an accummulator 40 in parallel by hydraulic lines or conduits 42. Accummulators are commonly used in hydraulic systems and essentially comprise a gas-filled bag within a rigid canister. Hydraulic fluid displaced into the accummulator between the canister and the gas bag causes the gas to compress. A flow control valve 44 is connected along the hydraulic lines between the accummulator and the hydraulic cylinders. Valve 44 restricts a return flow of fluid from the accummulator to the piston and cylinder combinations 26, but does not interfere with the flow of fluid from the cylinders to the accummulator. A coupler 46 is connected to the hydraulic lines for charging the circuit with pressurized hydraulic fluid from a hydraulic system of the tractor 2. Once the accummulator, the piston and cylinder combinations, the conduits and the flow control valve are charged, they form a closed hydraulic system.

In operation, the hydraulic system of the rake illustrated in FIG. 6 is first charged through the coupler 46 with hydraulic fluid from the tractor hydraulic system. The pressure at which the system is charged is one way of adjusting the force required to deflect the teeth 20. The operator can set the pressure according to conditions and experience. Additionally, as mentioned above, movement of the lugs 34 along the teeth 20 is a second way of adjusting the force required to deflect the teeth. After these initial adjustments have been made, there are no controls which the operator is required to use during the raking operation and this is an important advantage of the invention.

The rake 4 is moved into the raking position shown in FIG. 1 by the arms 6 using the standard controls of the tractor. The tractor is then moved forwardly to begin the raking operation. The slash or other material is pushed forwardly and the teeth remain in the position shown in FIG. 1 in solid lines unless they encounter a fairly heavy or immovable object such as a large rock or a stump. Continued forward motion of the tractor causes the teeth encountering the object to be pivotally moved rearwardly towards the position shown in broken lines in FIG. 1.

The pivotal movement of one or more of the teeth causes the piston rod and piston of the piston and cylinder combination associated with each of the pivotted teeth to move upwardly within its cylinder. This displaces the hydraulic fluid within the piston and cylinder combination and forces the fluid through the hydraulic lines 42 and flow control valve 44 into the accummulator 40. As mentioned above, valve 44 does not impede the flow in this direction.

The pressurized fluid displaced into the accummulator from one or more cylinders tends to flow back towards the cylinders and reverse the pivotal movement of the teeth as soon as each tooth is clear of the object which caused the pivotal movement. However, flow control valve 44 restricts the flow of fluid from the accummulator back to the cylinders and thereby comprises a means for controlling the rate of the reverse pivotal movement. This is extremely advantageous because, if the teeth were free to snap back immediately after the object is cleared, this would cause considerable stress on the shafts 22 and journals 24, requiring more rugged construction in order to avoid possible failure, could cause the teeth to break if they should strike another object when snapping back, or could throw a small rock or other object forwardly and create a hazard for persons in the area. However, valve 44 controls the return flow of fluid and allows the teeth to return to the downwardly extending position at a controlled rate.

In a preferred embodiment of the invention shown only in FIG. 1, one or more wheels 50 are rotatably mounted on struts 52 connected to the back side of the blade 4. As seen in FIG. 1, bottom 54 of the wheel is generally even with bottom ends 56 of teeth 20. Wheel 54 provides depth control for the teeth 20, assuring that they stay close to the surface of the ground, without digging in.

What is claimed is:

1. A rake for use with tractors, comprising:

a blade connectable to a tractor and having a top, a bottom and front and back sides which are substantially vertical when the blade is connected to the tractor;

a plurality of teeth spaced-apart in a row and extending from the bottom of the blade, each said tooth having a lug selectively connected thereto in one of a plurality of positions along said each tooth;

a shaft and journal combination pivotally connecting each of the teeth to the blade and permitting independent pivotal movement of said each tooth away from objects encountered by said each tooth when the tractor moves;

a plurality of fluid piston and cylinder combinations, each said combination having a cylinder pivotally connected to the back side of the blade near the top of the blade and a piston rod pivotally connected to the lug of one of the teeth so the pivotal movement of the teeth displaces pressurized fluid within the piston and cylinder combinations, the pressurized fluid reversing the pivotal movement when the teeth clear said objects a fluid accummulator and fluid conduits connecting the piston and cylinder combinations to the accummulator in parallel, the accummulator receiving pressurized fluid displaced from the piston and cylinder combinations when the teeth are pivotally moved by the objects;

a coupler for charging the circuit with pressurized hydraulic fluid from a hydraulic system of the tractor;

means for controlling the rate of the reverse pivotal movement comprising a flow control valve along the fluid conduits between the accummulator and the piston and cylinder combinations to restrict a return flow of fluid from the accummulator to the piston and cylinder combinations when the teeth clear the objects;

the accummulator, the piston and cylinder combinations, the conduits and the flow control valve comprising a closed hydraulic system after being charged with pressurized hydraulic fluid; and a wheel rotatably mounted on the back side of the blade so the bottom of the wheel is generally even with the bottom ends of the teeth.

* * * * *